United States Patent [19]

Wilson

[11] Patent Number: 4,991,329

[45] Date of Patent: Feb. 12, 1991

[54] CANVAS STRETCHER RETAINING CLIP FOR PICTURE FRAMES

[75] Inventor: William G. Wilson, 3129 Lookaway Trail, Chattanooga, Tenn. 37406

[73] Assignees: William G. Wilson; David H. Turner, Chattanooga, Tenn.

[21] Appl. No.: 420,291

[22] Filed: Oct. 12, 1989

[51] Int. Cl.[5] ..... A47G 1/06

[52] U.S. Cl. ..... 40/156; 160/380; 38/102.2

[58] Field of Search ..... 40/152.1, 156, 603, 40/152, 155; 248/490, 491; 24/296, 350, 351, 354, 355; 160/380; 38/102.1, 102.2, 102.91

[56] References Cited

U.S. PATENT DOCUMENTS

| | | | |
|---|---|---|---|
| 481,117 | 8/1892 | Nuegele | 40/648 |
| 1,248,783 | 12/1917 | Andrews | 38/102.2 |
| 1,361,624 | 12/1920 | Schmidt | 38/102.91 |
| 2,698,470 | 1/1955 | Buedingen | 40/156 |
| 2,760,299 | 8/1956 | Gabel et al. | 38/102.2 |
| 4,027,413 | 6/1977 | Moede | 40/156 |

*Primary Examiner*—Kenneth J. dorner
*Assistant Examiner*—James M. Gardner
*Attorney, Agent, or Firm*—Alan Ruderman

[57] ABSTRACT

A clip formed from a resilient wire rod having a circular cross sectional configuration utilized for installing a canvas stretcher frame within a decorative picture frame. The clip has an elongated central body portion connecting first and second legs at opposite ends thereof. A sharpened projection extends from the free end of a first leg while a resiliently deformable retaining portion is formed adjacent the free end of the second leg. The diameter of the wire rod is smaller than the clearance space formed between the rabbet groove of the picture frame and the adjacent rail or stile of the stretcher frame. The first leg is inserted into the clearance space with the central portion overlaying the clearance space portion of the rearwardly facing edge of the rabbet groove, and thereafter the clip is rotated so the central section swings over the adjacent rail or stile of the stretcher frame. The clip may then be forcibly pushed down so that the second leg grasps the edge of the rail or stile remote from the clearance space. The clip can be used with not only picture frames having shallow rabbet grooves, but also picture frames having deep rabbet grooves wherein the rearwardly facing surface of the rails and stiles of the stretcher frame would be at or below the rearwardly facing surface of the picture frame.

6 Claims, 1 Drawing Sheet

CANVAS STRETCHER RETAINING CLIP FOR PICTURE FRAMES

BACKGROUND OF THE INVENTION

This invention relates to the retaining of a canvas stretcher frame within a picture frame, and more particularly to a universal clip for use in conjunction with decorative picture frames having a canvas stretcher frame receiving rabbet grooves of varying depths for retaining the stretcher frame in the picture frame.

A substantial amount of artwork, such as those which use oil paints as a medium, is applied directly on a canvas backing which is stretched tautly about a stretcher frame. The prior art has used small nails or brads driven into both frame members, or other similar means where the rabbet groove in the picture frame is shallow relative to the stretcher frame such that the rear surface of the stretcher frame extends above the rear surface of the picture frame. In those cases where the picture frame has a deep rabbet such that the rear stretcher frame is at the same or lower level as the rear of the picture frame, brads or small metallic triangular tabs such as glazier tabs have been used. In all these cases extreme care must be exercised in the attachment process or damage to the frame members can readily occur. Additionally, if one marketing canvas artwork were desired to display the work in a frame which is not sold with the artwork, or would like to temporarily mount the work in different frames for showing a customer how the work will appear in a number of other frames, these prior art mounting means are not practical.

One solution to some of the deficiencies in this prior art is proposed in Moede U.S. Pat. No. 4,027,413 which discloses a clip having a main body of a rectangular form having a first leg having a pair of points at one end for engaging the rabbet groove of the picture frame between the adjacent walls of the rabbet and the edge of the stile or rail of the stretcher frame, and a second leg that resiliently engages the other edge of the same stile or rail, the main body being disposed on the rear surface of the stile or rail. The disadvantage of this clip is that it only functions in those situations where the rear face of the stile or rail of the stretcher frame extends beyond the rear face of the picture frame, i.e., the rabbet groove is shallow relative to the front to rear thickness of the stretcher frame. This clip is not functional where the picture frame has a deep rabbet groove relative to the thickness of the stretcher frame, such as those picture frames having a highly decorative carved configuration. The reason for this is because the body of the clip must be rotated about the points of the first leg over the stile or rail to move the second leg into frictional engagement with the remote edge of the stile or rail, and since this requires leverage to be applied on the points with the remainder of the leg acting as a lever, no surface is available in a deep rabbet groove for the first leg to function as a lever so that the second leg cannot be rotated to engage the remote edge of the stretcher frame. Since the stiles and rails of stretcher frames have standard widths, this prior art clip is not universally applicable for use with all picture frames, i.e., they cannot be used with picture frames having deep rabbet grooves.

SUMMARY OF THE INVENTION

Consequently, it is a primary object of the present invention to provide a universal clip that can be used to retain canvas stretcher frames within the rabbet of picture frames having rabbets of a depth such that the rabbet is shallower, deeper or equal to the front to rear thickness of the stretcher frame stiles and rails.

It is another object of the present invention to provide a universal clip for retaining canvas stretcher frames within the rabbet groove of a decorative picture frame, the clip having a width less than the clearance space between the wall of the picture frame formed by the rabbet groove and the adjacent peripheral edge of a stile or rail of the canvas stretcher frame so that a first leg portion of the clip may be inserted into the clearance space with the entire clip overlaying the rearwardly facing surface of the rabbet groove and so that the clip may first be pivoted to dispose substantially the remainder of the clip in overlaying relationship with the stile or rail of the stretcher frame and then pivoted forwardly toward the stile or rail to frictionally engage the edge thereof remote from the peripheral edge by a second leg portion of the clip.

It is a further object of the present invention to provide a universal clip for retaining canvas stretcher frames within the rabbet groove of a decorative picture frame, the clip having a wire rod of circular cross sectional configuration smaller than the clearance space between the wall of the picture frame formed by the rabbet groove and the adjacent peripheral edge of a stile or rail of the canvas stretcher frame and so that a first leg portion of the clip may be inserted into the clearance space with the entire clip overlaying the rearwardly facing surface of the rabbet groove and so that the clip may first be pivoted to dispose substantially the remainder of the clip in overlaying relationship with the stile or rail of the stretcher frame and then pivoted forwardly toward the stile or rail to frictionally engage the edge thereof remote from the peripheral edge by a second leg portion of the clip.

Accordingly, the present invention provides a clip formed from a resilient wire rod having a cross sectional configuration smaller than the clearance space between the front to rear extending wall surface of the rabbet groove formed in the picture frame and the adjacent peripheral edge of the stiles and rails that form the canvas stretcher frame. The clip has an elongated central section connecting first and second legs at opposite ends thereof. A sharpened projection extends from the free end of the first leg while a resiliently deformable portion is formed adjacent the free end of the second leg. The first leg is inserted into the clearance space with the central section overlaying and substantially aligned with the longitudinal direction of the clearance space and the rabbet groove and thereafter the clip is pivoted so that the central section rotates or swings over the adjacent stile or rail of the stretcher frame while the free end of the first leg engages the rearwardly extending surface of the rabbet groove. Thereafter the central section is pushed toward the stile or rail with the free end of the first leg acting as a fulcrum until the free end of the second leg frictionally engages the front to rear extending edge of the stile or rail. Because of the ability of the clip to rotate or swing from the overlaying relationship with the clearance space and the rabbet groove to the overlaying relationship of the central section with the stile or rail, the clip can be utilized with deep rabbet groove picture frames as well as shallow rabbet groove picture frames to rapidly secure the canvas stretcher frame to the picture frame.

Release of the clip from the interlocking engagement of the picture frame and the stretcher frame may occur by reversing the aforesaid steps.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
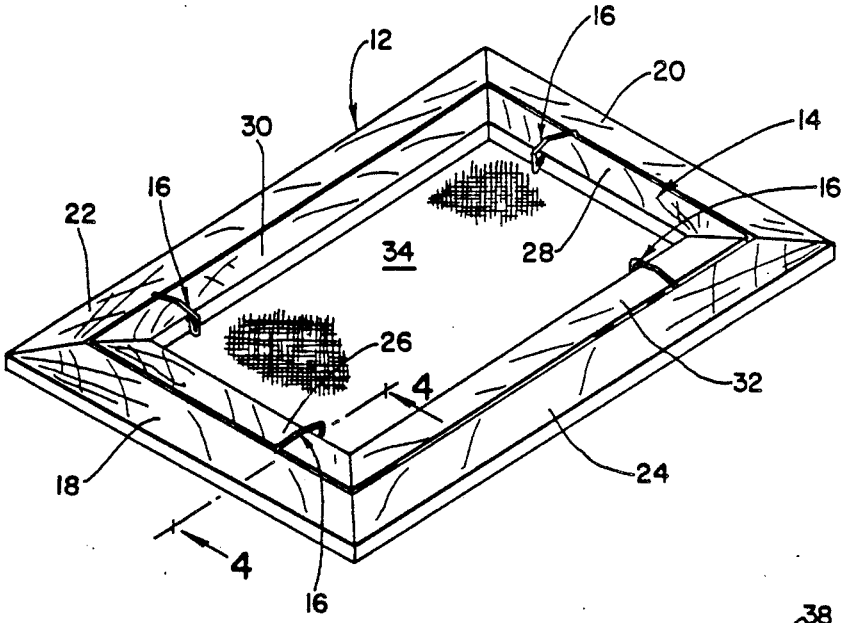
FIG. 1 is a rear perspective view of a canvas stretcher frame mounted in a decorative picture frame by retaining clips constructed in accordance with the principles of the present invention.
Figure 2:
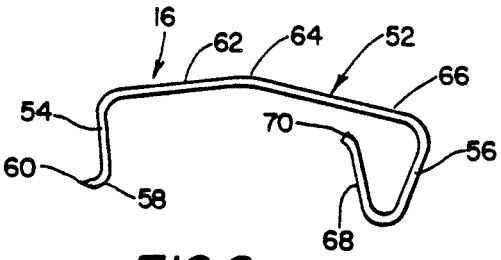
FIG. 2 is an elevational view of a retaining clip constructed in accordance with the present invention.
Figure 4:
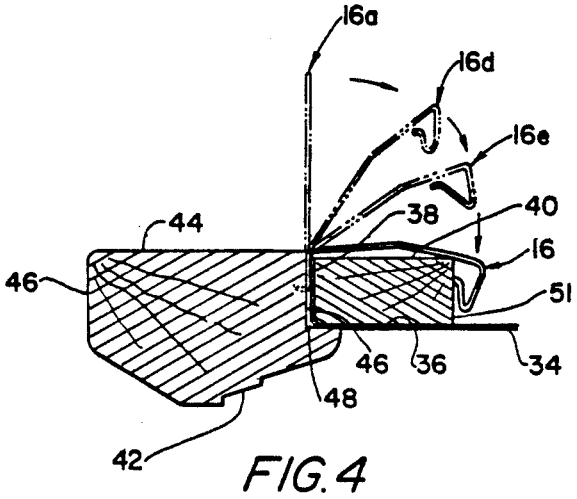
FIG. 4 is a cross sectional view taken along line 4—4 of FIG. 1 illustrating the subsequent steps of installing the retaining clip.

Referring now to the drawings, and in particular to FIG. 1, the rear of a decorative picture frame 12 is illustrated having a canvas stretcher frame 14 fastened thereto by means of retaining clips 16 constructed in accordance with the principles of the present invention. Both the picture frame 12 and the stretcher frame 14 are of conventional form, each being of a rectangular configuration. Thus, the picture frame 12 comprises at least a pair of spaced apart rail members 18,20 connected by miter joints at opposite ends to a respective stile member 22, 24 while the stretcher frame 14 comprises a pair of rail members 26, 28 also connected by miter joints at opposite ends to respective stile members 30, 32. An art bearing canvas fabric is tautly stretched over the front faces of the rail and stile members of the stretcher frame as exemplified by face 36 as illustrated in FIG. 4 and secured thereto at the outer edge surfaces, i.e., the front to rear extending peripheral edge 38, or to rear face 40, by staples or the like (not illustrated) as is customary in the art. The rail and stile members of the picture frame 12 have a decorative front face 42, a rear face 44 spaced therefrom, an outer edge 46 of any desired decorative configuration, and an inwardly facing edge 46 extending rearwardly from a ledge 48. The edge 46 and the ledge 48 define a rabbet groove for receiving the stretcher frame 14 with the peripheral edge 38 spaced therefrom by a very small clearance space 50.

As aforesaid, brads or the like or tabs have been utilized in the prior art to secure the stretcher frame 14 into the rabbet groove of the picture frame. An improvement to this approach is the retaining clip disclosed in the aforesaid U.S. Pat. No 4,027,413 constructed from a rectangular strip of metal into a configuration which has prongs extending from the end of an upstanding leg for grasping the edge 46 of the rabbet groove, the leg being connected to a body member for overlaying the rear surface 40 of the stretcher frame and a downwardly extending resilient leg for abutting the inwardly facing front to rear extending edge 51 of the rails and stiles of the stretcher frame. However, that retaining clip can only be utilized with picture frames having a relatively shallow rabbet groove compared to the thickness of the stretcher frame, i.e , where the depth of the edge 46 from the rear surface 44 of the picture frame to the ledge 48 is less than the peripheral edges 38 of the stretcher frame. If the length of the edge 46 is equal to or greater than the edge 38 the prongs extending from the first leg precludes all but a small portion of the first leg from entering the clearance space 50 since the prongs must extend from the first leg an amount greater than the clearance space, and thus leverage cannot be applied to permit the clip to rotate toward the rear surface of the stretcher frame to engage the edge 51 with the second leg.

To overcome this deficiency of the prior art and provide a universal retaining clip which is operable with picture frames having various decorative configurations and thus rabbet grooves which may be deep relative to the thickness of the stretcher frame, e.g , the length of the rabbet groove edge 46 may be equal to or greater than the length of the peripheral edge 38 of the stretcher frame, the present invention provides the retaining clip 16 which permits its use with such picture frames as well as those frames wherein the rabbet groove is shallow.

Accordingly, although the clip 16 is similar to the clip illustrated in the aforesaid U.S. Patent in that it has a central body portion 52 longer than the width of the rails and stiles connecting a pair of spaced apart legs 54 and 56, it differs therefrom in substantially all other aspects. The clip 16 is constructed from a resilient metal wire rod such as welding rod having a cross sectional configuration. The diameter of the rod must be small enough such that it is slightly less than the clearance space 50 which is substantially standard in the art in that the size of the stretcher frames, including the stiles and rails thereof, are standard as is also the rabbet groove of conventional picture frames. For example, a wire rod of one-sixteenth inch diameter constructed from steel welding rod functions well for these purposes. The leg 54 preferably should be of a length no more than the thickness of the stretcher frame stiles and rails, i.e., the length of the edge 38, although as hereinafter made clear it may be slightly longer. The end of the leg 54 remote from the body portion 52 is bent out of the axis of the leg 54 so as to have a small protuberance 58 which terminates at a point 60 which is formed by cutting the end at an angle which may be approximately 45° . The length of the protuberance 58 from the axis of the leg 54 to the free end of the point 60 preferably should be slightly greater than the clearance space 50, and should be slightly greater than the clearance space less one-half of the diameter of the rod. The central body portion 52 preferably has a first section 62 extending from the axis of the leg 54 at an angle somewhat greater than 90°, e.g., 110°, and extends toward a crown 64 from which a second or remaining section 66 is angled back to the axis of the second leg 56, the angle the section 66 makes with the leg 56 being approximately the same as the angle the section 62 makes with the leg 54. Thus, the length of the central body portion 52 is greater than the distance between the legs 54 and 56 at their respective junction with the central body portion and, because of the resiliency of the wire art, the clip can accommodate variations in the width of the stretcher frame rails and stiles, e.g., the length of the rear face 40, and the variations in the clearance spaces 50 resulting from manufacturing tolerances and the nature of the soft wood from which the picture frames and stretcher frames are made. The axis of the second leg 56 preferably depends from the central body portion 52 slightly toward the axis of the first leg 54, i.e., inclined slightly inwardly relative to the axis of the first leg 54. Moreover, at a disposition where the leg 56 is spaced from its junction with the central body portion 52 an amount that is substantially equal to the spacing between the protuberance 58 of the first leg 54 from its junction with the central body portion 52, the second leg is bent upwardly and inwardly to form a retaining portion 68. The retaining portion 68 forms an acute angle with the major axis of the leg 56 and terminates at a free end 70 bent slightly from the axis of the retaining portion 68 toward the first leg 54, the free end 70 being adopted to forcibly abut the edge 51 of the stretcher frame 14 when the point 60 of the first leg 54 has been finally positioned into the edge 46 of the rabbet groove in the picture frame as hereinafter described.

Figure 3:
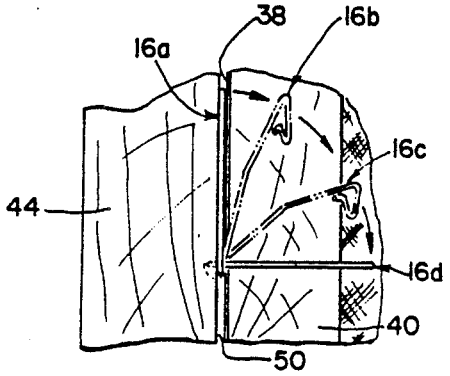
FIG. 3 is a rear plan view of a portion of the picture frame and the stretcher frame illustrated in FIG. 1 and illustrating the initial steps of installing the retaining clip.
Figure 5:
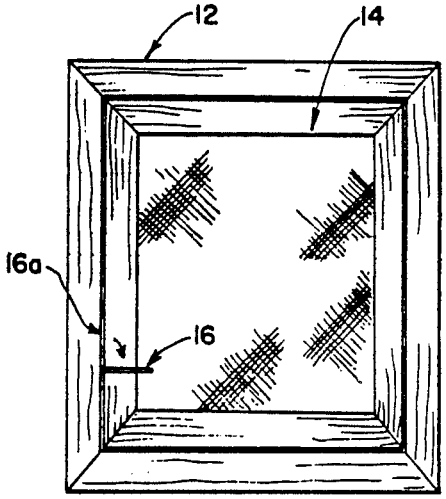
FIG. 5 is a rear plan view of the picture frame and the stretcher frame and illustrating the retaining clip installing procedure.

In operation, the stretcher frame 14 is positioned face down onto the rabbet groove in the rear of the picture frame, and the stretcher frame is centrally positioned so that the clearance space 50 is available about the periphery of the rails and stiles. A clip 16 is then inserted with the leg 54 and the protuberance 58 disposed into the clearance space 50 and with the central body portion 52 disposed above the clearance space in overlaying relationship therewith as illustrated in FIGS. 3 through 5 at 16*a*. The leg 54 may be depressed into the clearance space 50 by any desired amount as long as the central body portion 52 is not inserted below the rear surface 40 of the stretcher frame. The clip is then rotated about the axis of the leg 54 so that the point 60 is pivotably moved into the rearwardly extending edge 46 of the rabbet groove and the central body portion moves over the rear face 40 of the respective rail and stile of the stretcher frame toward the canvas as illustrated in stepwise fashion in FIG. 3 at 16*b* and 16*c* until the central body portion 52 overlays substantially the entire width of the face 40. At that time the central body portion 52 is disposed as illustrated at 16*d* in FIGS. 3 and 4 and is then pushed downwardly toward the face 40 as illustrated at 16*e* in FIG. 4 until the free end 70 of the second leg tightly grips the edge 51 of the stretcher frame rail or stile, the point 60 merely digging deeper into the edge 46. Each rail 26, 28 and stile 30, 32 is similarly secured to the picture frame in a similar manner by one or more clips 16.

Because the leg 54 of the clip 16 is first inserted into the clearance space and the clip thereafter rotated about the axis of the leg 54, the clip can be utilized with picture frames having deep or shallow grooves. That is, the rear face 40 of the stretcher frame rails and stiles can be level with or below the rear face 44 of the picture frame and because the rotation about the axis of the leg 54 permits the clip to be properly positioned for the subsequent step of pushing it downwardly into gripping relationship with the stretcher frame member. This is unlike the clip in the aforesaid U.S. Patent which cannot function under these circumstances, but is only operable where the face 40 is above the face 44, i.e., the rabbet groove is shallow. Of course the clip of the present invention is also operable where the rabbet groove is shallow. The clip can be readily removed, when desired, merely by grasping the crown 64 or the leg 56 and pulling up, and if the first leg is within a deep rabbet groove, rotating the clip about the axis of the leg 54.

The shape of the clip 16 permits its use for stretcher rails and frames which vary somewhat from the standard. Firstly, the crown 64 permits the length of the central portion from the leg 54 to the leg 56 to expand when a widened rail or stile is encountered so that the free end 70 can engage the edge 51 thereof. Secondly, the free end 70 in the normal state extends beneath the central portion to approximately one-half the length of the section 66 so that it can grasp the edge 51 in relatively narrow rails or stiles while the crown remains unchanged from its normal state. Thirdly, the retaining portion 68 has an arcuate concave configuration so that as the central body portion is pushed downwardly, the crown at the junction between the surfaces 40 and 51 engages the curved portion prior to the end 70 engaging the edge 51 and permits the retaining portion to slide downwardly on the corner until the free end 70 frictionally grips the edge 51 which permits the clip to easily be finally positioned.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A clip means retaining a canvas stretcher frame having a polygonical outer peripheral configuration with a rabbet groove formed about a central opening of a decorative picture frame, said stretcher frame comprising a plurality of wooden bars having a first rearwardly extending edge forming the outer periphery of said stretcher frame and a second rearwardly extending edge spaced from said first edge and defining a front and rear face therebetween, said rabbet groove having the same polygonical configuration as the canvas stretcher and being defined by a rearwardly facing ledge for abutting a peripheral portion of the front face of the stretcher frame and an inwardly facing surface extending rearwardly from said ledge and facing the outer periphery of the stretcher frame, said outer periphery of the stretcher frame being spaced from said inwardly facing surface of said rabbet groove to define a clearance space therebetween, said clip comprising a resilient metallic wire rod having a circular cross sectional configuration of a diameter no greater than said clearance space, said rod having an elongated central body portion of a length greater than the distance between said first and second edges, said body having first and second ends, a first leg extending from said first end away from said body portion, a second leg extending from said second end, said first and second legs being disposed on the same side of a plane passing through said first and second ends of said body portion, said first and second legs being angularly inclined toward each other inwardly relative to said body portion, said first leg terminating at a pointed protuberance directed oppositely to said body portion and away from said second end for piercing said inwardly facing surface of said rabbet groove when said body portion has been positioned in overlaying relationship with said rear face of a bar, said second leg terminating in a retaining portion extending toward said first leg for forcibly abutting the second rearwardly extending edge of said bar, said protuberance and a portion of said first leg being adapted to be inserted into said clearance space with said central body portion disposed in overlaying relationship with said clearance space and thereafter rotated so that said body portion overlies said rear face, thereby to permit said body portion to be movable toward said rear face to forcibly abut said retaining portion with said second rearwardly extending edge to secure said bar within said rabbet.

2. A clip as recited in claim 1, wherein said body portion includes a bend forming a crown disposed substantially intermediate the ends thereof so that the length of said body portion is longer than a straight line extending between the ends thereof.

3. A clip as recited in claim 1, wherein said pointed protuberance is disposed substantially parallel to said plane.

4. A clip as recited in claim 1, wherein said retaining portion includes an arcurate form extending at an acute angle from said second leg.

5. A clip as recited in claim 5, wherein said retaining portion includes an arcurate form extending at an acute angle from said second leg.

6. A method for retaining a canvas stretcher frame into a rabbet groove at the rear of a decorative picture frame, said rabbet groove having a rearwardly facing surface and an inwardly facing surface substantially normal to the rearward facing surface, said method comprising the steps of: providing a clip having an elongated central body portion, a first leg extending from one end of said body and having a pointed protuberance extending from the distal extremity of said first leg outwardly relative to said central body, and a second leg extending from the other end of said body and having a resilient retaining portion directed inwardly relative to said central body for forcibly abutting a stretcher bar between said first and second legs, said clip having a circular cross sectional configuration, installing said stretcher frame in the rabbet groove with said bar spaced from said inwardly facing surface of the rabbet groove by a distance no smaller than the diameter of said clip to form a clearance space, inserting the protuberance and a portion of said first leg of the clip into the clearance space with the central portion of said body disposed in overlying relationship with said rearwardly facing surface in alignment with said clearance space, rotating said clip toward said stretcher frame to pierce said inwardly facing surface with said pointed protuberance and to dispose said central body above said bar, and pushing said body and said second leg toward said bar to engage said retaining portion against an edge of said bar remote from said clearance space to apply a force to said bar directed toward said clearance space.

* * * * *